US007111695B2

(12) United States Patent
Puttmann

(10) Patent No.: US 7,111,695 B2
(45) Date of Patent: Sep. 26, 2006

(54) PNEUMATIC ROCK-BORING DEVICE AND METHOD FOR HORIZONTAL DRILLING USING COMPRESSED AIR AND DRILLING MEDIUM

(75) Inventor: Franz-Josef Puttmann, Lennestadt (DE)

(73) Assignee: Tracto-Technik GmbH, (DE)

( * ) Notice: Subject to any disclaimer, the term of this patent is extended or adjusted under 35 U.S.C. 154(b) by 118 days.

(21) Appl. No.: 10/433,294

(22) PCT Filed: Nov. 30, 2001

(86) PCT No.: PCT/EP01/13988

§ 371 (c)(1),
(2), (4) Date: Oct. 6, 2003

(87) PCT Pub. No.: WO02/44508

PCT Pub. Date: Jun. 6, 2002

(65) Prior Publication Data

US 2004/0060740 A1 Apr. 1, 2004

(30) Foreign Application Priority Data

Dec. 2, 2000 (DE) ..... 100 59 983
Sep. 18, 2001 (DE) ..... 101 46 025

(51) Int. Cl.
*E21B 21/14* (2006.01)

(52) U.S. Cl. ..... 175/69; 175/205

(58) Field of Classification Search ..... 175/69, 175/70, 205, 212, 296
See application file for complete search history.

(56) References Cited

U.S. PATENT DOCUMENTS

| | | | | |
|---|---|---|---|---|
| 1,868,400 | A | | 7/1932 | Stover |
| 3,101,796 | A | | 8/1963 | Stall et al. |
| 3,162,251 | A | | 12/1964 | Bassinger |
| 3,712,388 | A | * | 1/1973 | Curington ..... 173/78 |
| 3,732,936 | A | | 5/1973 | Sudnishnikov et al. |
| 4,474,252 | A | | 10/1984 | Thompson |
| 4,858,703 | A | | 8/1989 | Kinnan |
| 5,143,162 | A | | 9/1992 | Lyon et al. |
| 5,427,190 | A | | 6/1995 | Mo |
| 5,695,014 | A | | 12/1997 | Jenne |
| 6,125,952 | A | | 10/2000 | Beccu et al. |

FOREIGN PATENT DOCUMENTS

| | | |
|---|---|---|
| DE | 44 33 533 C | 11/1995 |
| DE | 44 33 533 C1 | 11/1995 |
| EP | 0 154 778 A1 | 9/1985 |
| EP | 0 154 778 B1 | 9/1985 |
| EP | 0171 374 A1 | 2/1986 |
| EP | 0 325 715 A2 | 8/1989 |
| GB | 2 179 381 A | 3/1987 |
| WO | WO 92/01138 | 1/1992 |
| WO | PCT/EP01/13988 | 11/2001 |

* cited by examiner

*Primary Examiner*—William Neuder
(74) *Attorney, Agent, or Firm*—Cook, Alex, McFarron, Manzo, Cummings & Mehler, Ltd.

(57) ABSTRACT

The invention relates to a method for horizontal ground drilling, in particular for rock drilling, by means of a ground drilling apparatus which can be driven forward in rotation and percussively, the apparatus having compressed air and drilling medium applied to it alternately or simultaneously, and the compressed air and the drilling medium being supplied via one channel.

15 Claims, 6 Drawing Sheets

PNEUMATIC ROCK-BORING DEVICE AND METHOD FOR HORIZONTAL DRILLING USING COMPRESSED AIR AND DRILLING MEDIUM

The invention relates to an apparatus for ground drilling, in particular for drilling in stone and rock, and claims the priority of German patent applications 100 59 983.4 and 101 46 025.2, to the content of which reference is made.

DE 44 33 533 C1 discloses a drilling apparatus with a hydraulic impact mechanism and a drilling head with nozzle openings, in which the impact mechanism and the nozzle openings can be connected to the same pressure medium source.

The apparatus described is based on the problem that, in the case of conventional drilling devices with an impact mechanism and a liquid supply, two pressure medium sources are required, since two types of pressure media have to be supplied. The two pressure medium sources lead to a complicated construction of the ram drilling apparatus. In addition, a plurality of pressure medium lines have to be provided which, in practical operation, often represent a source of operational faults. In DE 44 33 533 C1, it is now proposed to use a drilling device with a hydraulic impact mechanism and to connect the nozzle openings of the drilling device and the impact mechanism to the same pressure liquid source.

Although this known apparatus solves the problem of restricting the supply of media for the percussion and for the flushing to one feed line, it forces the operator to fall back on a hydraulic drilling apparatus, and therefore to tolerate the disadvantages which are inherent in the hydraulic impact mechanisms. U.S. Pat. No. 4,858,703 describes a pneumatic ram drilling apparatus in which the liquid is supplied to the pressure chamber of the impact piston and via the latter, by means of the compressed air that drives the impact piston, is conveyed through the impact piston to a nozzle at the head of the ram drilling device. The effect of the compressed air is thus that the liquid is forced out of the chamber in sudden bursts.

Although the device described has a common chamber and a through-line for the compressed air and drilling liquid within the ram drilling apparatus, as in all further known devices, it falls back on a separate supply of compressed air and drilling liquid, so that the two lines are only combined in the drilling device.

Proceeding herefrom, the invention is based on the object of providing an improved apparatus for trenchless drilling, laying lines in the ground or drilling in rock, which has a simplified supply of operating medium.

The object is achieved by an apparatus and a method as claimed in the independent claims. Advantageous refinements are the subject matter of the subclaims.

The invention permits a common food line to be used for the compressed air and the drilling liquid. As a result, the design of the feed line and of the drilling device can be simplified. This is advantageous in particular when drilling with strings, since it is now possible to use a string with a single media channel, via which the compressed air and the drilling medium can be supplied to the drilling apparatus alternately or simultaneously.

During the percussive forward drive of the drilling apparatus, the impact device can thus be supplied and operated with compressed air via the channel present in the string, while for the drilling, the supply of compressed air and therefore the percussive forward drive is interrupted and a drilling medium can be fed to the drilling apparatus via the same feed line. The drilling medium can be fed to the drilling head as a cooling liquid, preferably water, in particular when drilling rock. Feeding can take place via the pressure chamber of the impact piston, which can have a connecting channel to the drilling head. When changing over to percussive forward drive, the compressed air source can then be connected to the feed line again, for example via a switching element, the drilling medium can be forced out of the feed line and the expansion chamber of the impact piston, and the impact piston can then be operated in a conventional way.

However, according to the invention, the drilling device can also be operated exclusively with compressed air or with a mixture of compressed air and liquid. In relation to the latter variant, the liquid can be sprayed into the compressed air. This can be done with the aid of a nozzle arranged in the air stream. The drilling device preferably has a feed line to the pressure chamber and, leaving the pressure chamber, a waste-air channel and a channel to the outlet nozzles of the drilling head, which channel can run through the piston. During operation with compressed air, in this case some of the air also escapes via the drilling head, while during operation with liquid, some of the liquid can escape via the waste-air channel.

In another embodiment, the channels are in each case closed by a specific piston position, so that in each case only the waste-air channel for the compressed air or the drilling head channel for the flushing medium is free.

The invention permits both the compressed air and the drilling medium, and also a mixture of the two, to be guided not only via the feed line but also via the expansion chamber of the impact piston, and therefore permits considerable design costs to be saved.

According to the invention, the drilling apparatus can have an axially movable tip, which has the effect of a particularly concentrated transmission of the impact impulse. It can also have an oversize, and in this way, by means of axial displacement of the drilling apparatus, can bring the impact piston out of a possible dead position (equilibrium position). In this case, the drilling apparatus is moved while the hammer tip remains fixed in the ground, because of its oversize, and transmits an impulse onto the piston with a foot that projects into the piston chamber on the piston side. This foot is preferably used at the same time for transmitting the impact impulse from the impact piston onto the hammer point tip during percussive forward drive of the drilling apparatus.

In a preferred exemplary embodiment, the feed line of the compressed air or of the drilling medium can be configured in such a way that an optional feed line into the pressure chamber for connecting up the impact drive and/or into the channels for the cooling, flushing or lubrication of the drilling tools is possible.

In a particularly preferred embodiment, connecting or disconnecting the impact drive is implemented by means of a valve or a through-hole that can be closed, which permits the feed line of the medium into the pressure chamber of the impact piston to be closed for the flushing and/or cooling mode with the impact drive switched off at the same time. In this case, the through-hole or the valve can be arranged within a pressure chamber provided in the ground drilling apparatus, the pressure chamber ensuring particularly rapid and reliable connection of the impact drive after it has been stopped.

It is also advantageous if the pressure chamber is formed as a pressure tube which is mounted within the housing such that it can be displaced axially between two positions, the valve or the through-hole being open in one position and closed in a second position. This permits particularly simple actuation of the control means, which can also be carried out via a pulling or thrusting means of the drilling device, such as a (drilling) string or cable.

In a further preferred embodiment, the pressure tube is arranged within a control tube of the ground drilling apparatus, the control tube opening the through-hole in one position and closing it in a second position. In this case, the pressure tube can be kept by a spring element in a basic position with the valve closed or the through-hole closed. This permits the impact drive to be connected in a particularly advantageous manner as a function of the force acting on the string or the pulling or thrusting means.

Furthermore, the chamber or the pressure tube can be connected to a supply line running through the impact piston to the drilling tool. With a constant media pressure, thorough flushing or cooling of the drilling tool can thus be achieved with the simultaneous connection or disconnection of the impact drive as desired. Displacement of the pressure tube into the "closed" position of the feed line for the pressure chamber of the impact piston preferably simultaneously effects closure of the waste-air channels. This can be achieved via slides in the region of the waste-air channels.

"Ground drilling apparatus" is to be understood, in particular, to mean any device which is moved in a channel which exists or is to be created, in order to make or widen a pilot bore or to replace, to clean [sic] an existing pipe in a destructive or nondestructive manner, to pull lines into existing pipes or other elongate bodies and all apparatus for construction work associated with driving forward underground. By its nature, however, the ground drilling device in the sense of this invention is not restricted to underground work. For example, lines which are cleaned by a ground drilling apparatus can also run above ground.

The term "channel" in the sense of the present invention comprises any type of ground line and underground or above-ground pipeline, bore in the ground, including a bore in rock, which may be widened, destroyed, cut open or cleaned by using an appropriate tool.

The invention will be explained in more detail below using an exemplary embodiment which is illustrated in the drawing, in which.

Figure 1:
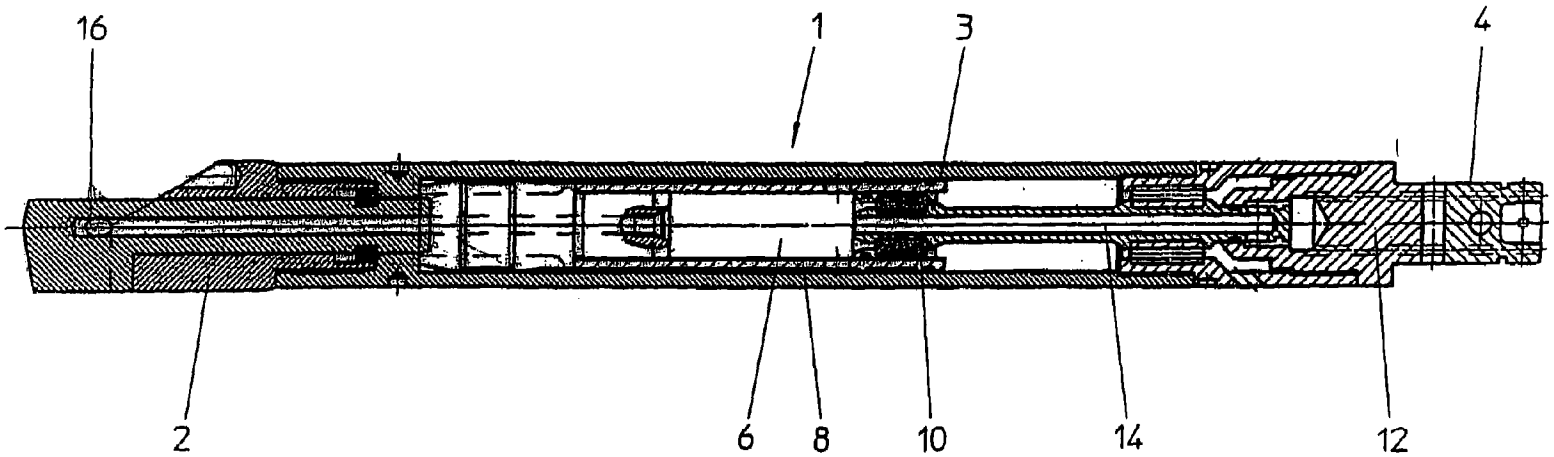
FIG. 1 shows the drilling apparatus according to the invention.

The drilling apparatus 1 has a drilling head 2 and a body 3. The drilling head 2 comprises a chisel tip 20 and a drilling tool 22. The chisel tip 20 has a central hole as a media channel 24 and is mounted in the drilling tool 22 such that it can be displaced axially. The drilling tool 22 has an outlet nozzle 26, which is made to overlap with a media channel 24 in the chisel point 20 when the chisel point is arranged in its rear position. In this position, the end 28 of the chisel point 20 on the piston side projects into the internal space of the body 3, so that an impact piston 30 mounted in this body such that it can move, in its forward position on the side of the drilling head, strikes the end (chisel foot) 28 on the piston side with its end face 32 and effects axial displacement of the chisel point 20 in the forward drive direction.

The chisel point 20 is secured in the drilling tool 22 by a securing means 80, which fixes the axial end position in the forward drive direction.

As compared with the drilling tool 22, the chisel point 20 has an oversize 21, so that longitudinal displacement can also be carried out by means of the friction with the ground surrounding the drilling head, for example as a result of pulling, on the drilling apparatus.

Since the media channel 24 of the chisel point 20 is made to overlap with the outlet nozzle 26 of the drilling tool 22 only in the rear position, the media channel 24 is closed in the front axial position of the chisel point 20.

The drilling apparatus according to the invention has a conventional impact drive with an impact piston 30 and a controller 34 with control bush 36, a control edge 38, a control tube 40, the usual resilient blocks 42, 44 and a waste-air channel 46. In the control tube 40 there runs a media channel 64 which is connected to the channel of a connected string and is located on an axis with a media channel 54 in the impact piston 30 and the media channel 24 in the chisel point 20. The impact piston has the usual channel guide for the piston movement brought about by the compressed air, and appropriate channels for changing over the control by means of the control edge 38 of the control bush 36.

The media channel 54 in the impact piston 30 has an opening on the side of the expansion chamber with a nozzle 56. The nozzle opening defines that proportion of the compressed air which escapes via the piston channel 54 during the operation of the impact piston 30. The opening of the nozzle 56 is dimensioned such that the escaping compressed air does not lead to any pressure loss which hampers the forward drive of the impact piston 30.

During percussive forward drive, that is operation of the drilling apparatus with compressed air, the compressed air is supplied in the usual way to an expansion chamber 10 of the body 3 via a line provided for the purpose. The compressed air effects, in the usual way, a sudden displacement of the impact piston 30 into its forward position, the impact piston 30 striking the chisel foot 28 with its end face 32 and, as a result, transmitting the percussive impulse onto the chisel point 20. As a rule, this percussive impulse will lead to only a slight axial displacement of the chisel, as long as the working face provides a certain resistance.

As a result of changing over the control, the direction of movement of the impact piston 30 is then reversed again, the compressed air escaping in the usual way via the waste-air channels 46.

During operation of the drilling apparatus 1 with water, the media channel previously used as a compressed-air channel is used for the feeding of drilling liquid. In this case, the drilling liquid flows through the media channel 64 in the control tube into the expansion chamber 10, fills the latter and flows via the nozzle 56 through the media channel 54 into the media channel 24 of the chisel point 20. As a result of the forward drive pressure exerted on the drilling apparatus via the drilling string and the opposing pressure exerted on the chisel point 20, during this procedure the chisel point 20 is in its rear piston-side position. At the same time, because of the drilling liquid in the expansion chamber 10, the impact piston 30 is located largely in its forward position, so that there is a direct connection between the media channel 54 of the impact piston 30 and the media channel 24 of the chisel point 20. At the same time, the media channel 24 is made to overlap with the outlet nozzle 26 of the drilling tool 22, so that the drilling liquid can emerge from the drilling head and be used for cooling and flushing.

If the drilling apparatus is to be operated with compressed air again, the compressed air source is changed over from drilling liquid to compressed air, the compressed air forcing the drilling liquid out of the drilling apparatus via the media channels 64, 54, 24 and the expansion chamber 10, until the impact piston 30 responds again.

If the impact piston 30 is in a dead position, in which the control edge 38 is located halfway over the control opening of the impact piston, and therefore there is no response from the impact piston, the drilling apparatus 1 can be pulled back, the chisel point 20 being displaced axially because of its oversize with respect to the drilling tool 22. As a result, the connection between the media channel 24 and the outlet nozzle 26 is broken. The abrupt state change in the pressure medium, produced as a result, in the expansion chamber 10 effects a displacement of the piston from the dead position (equilibrium position) and thus a response from the piston. Should the displacement of the piston 30 not overcome the dead position, the drilling apparatus can be pushed forward abruptly via the string, as a result of which the piston 30 jumps back by means of the impulse exerted on the end face 32 of the piston 30 via the chisel point 20, and in this way is brought out of the equilibrium position in every case.

Using the apparatus described, percussive forward drive with compressed air can be combined with drilling forward drive, in which flushing is carried out with drilling liquid. The apparatus according to the invention has a simple construction, in spite of this dual function, and in addition requires no complicatedly configured feed lines and can fall back on one channel.

However, even during hammering, the drilling apparatus 1 according to the invention can be supplied with drilling liquid and in this way can be operated without overheating of the drilling tool 22 and with the drilling debris being transported away. For this purpose, the drilling apparatus is fed with an air/water mixture. Up to a certain water concentration, the impact piston 30 of the drilling apparatus 1 can be operated with air impregnated with water, so that, with simultaneous percussive forward drive, drilling liquid emerges from the outlet nozzle 26.

Figure 2:
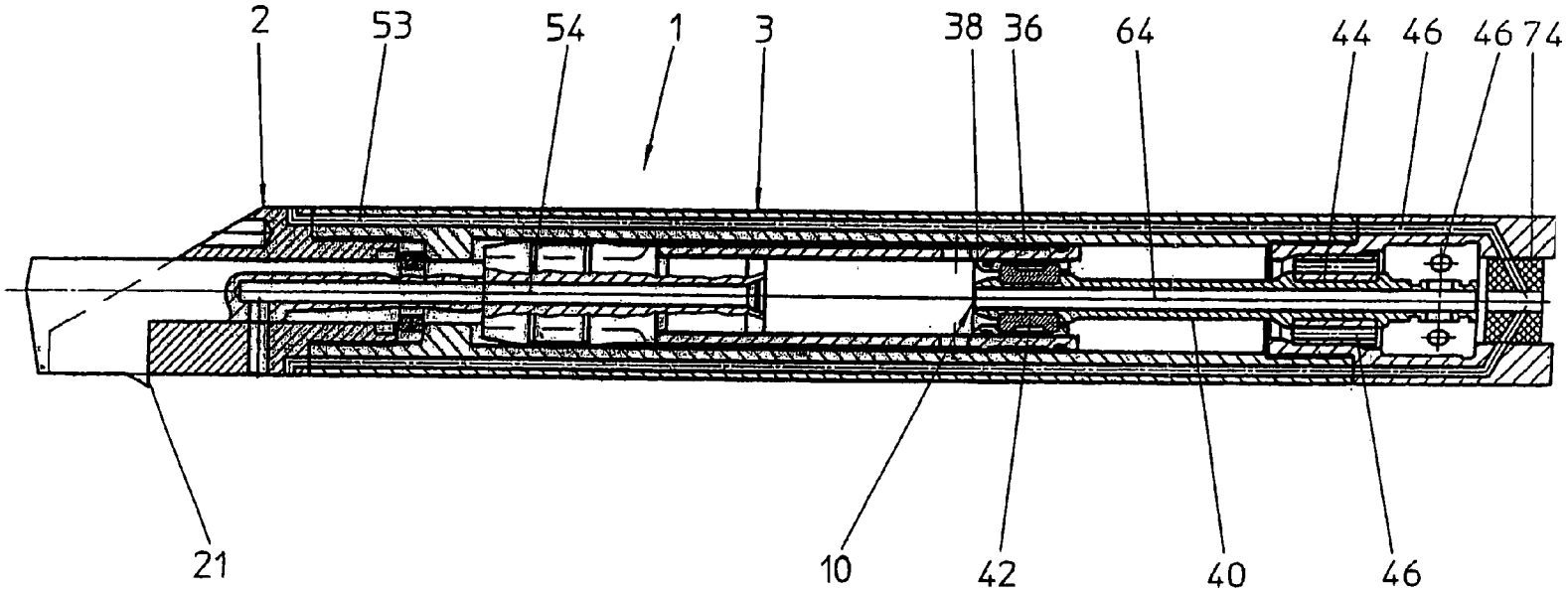
FIG. 2 shows the drilling apparatus of FIG. 1 with separator and lateral liquid line in the open nozzle position.
Figure 3:
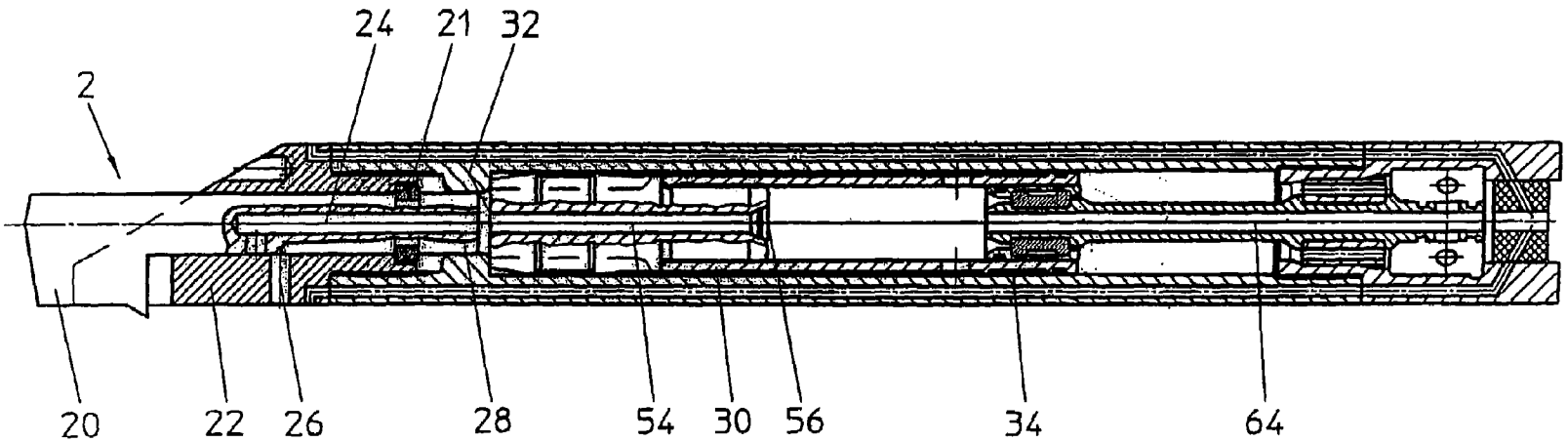
FIG. 3 shows the drilling apparatus of FIG. 2 in the closed nozzle position.
Figure 4:
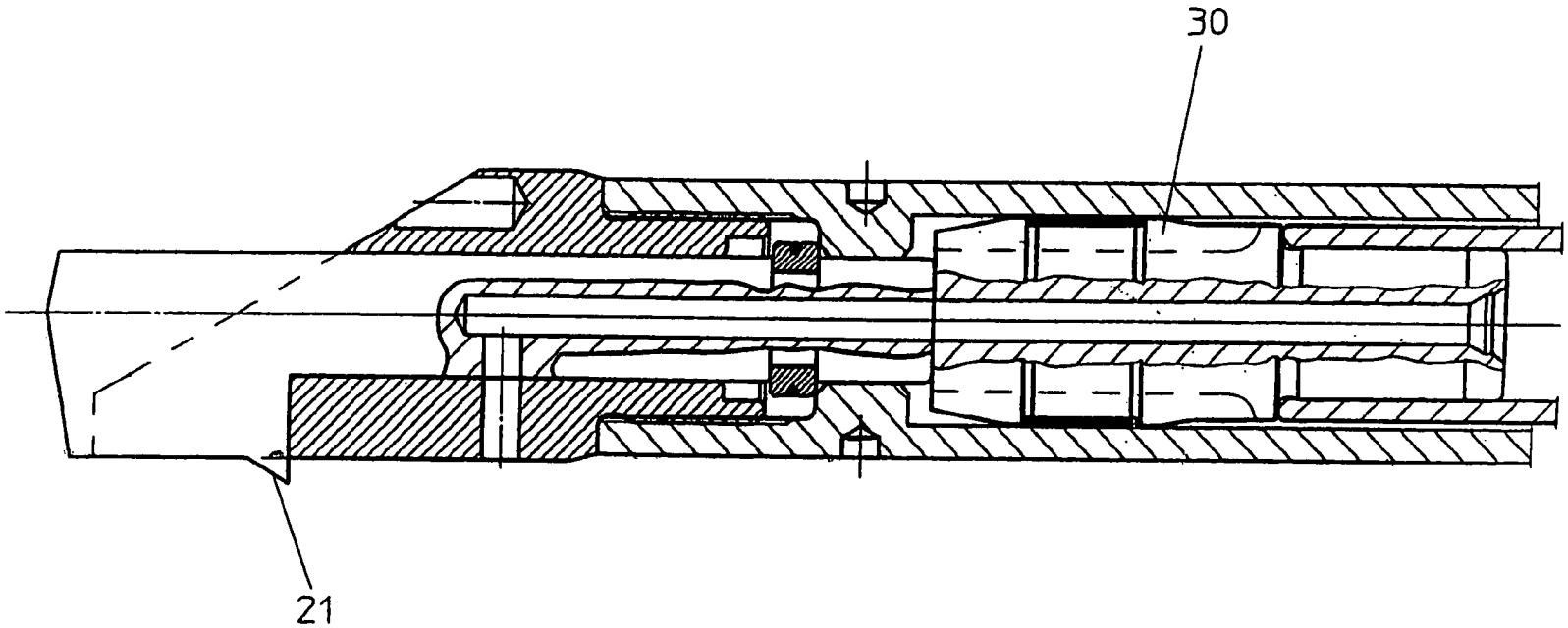
FIG. 4 shows the drilling head of the drilling apparatus according to FIG. 1 with open nozzle position.
Figure 5:
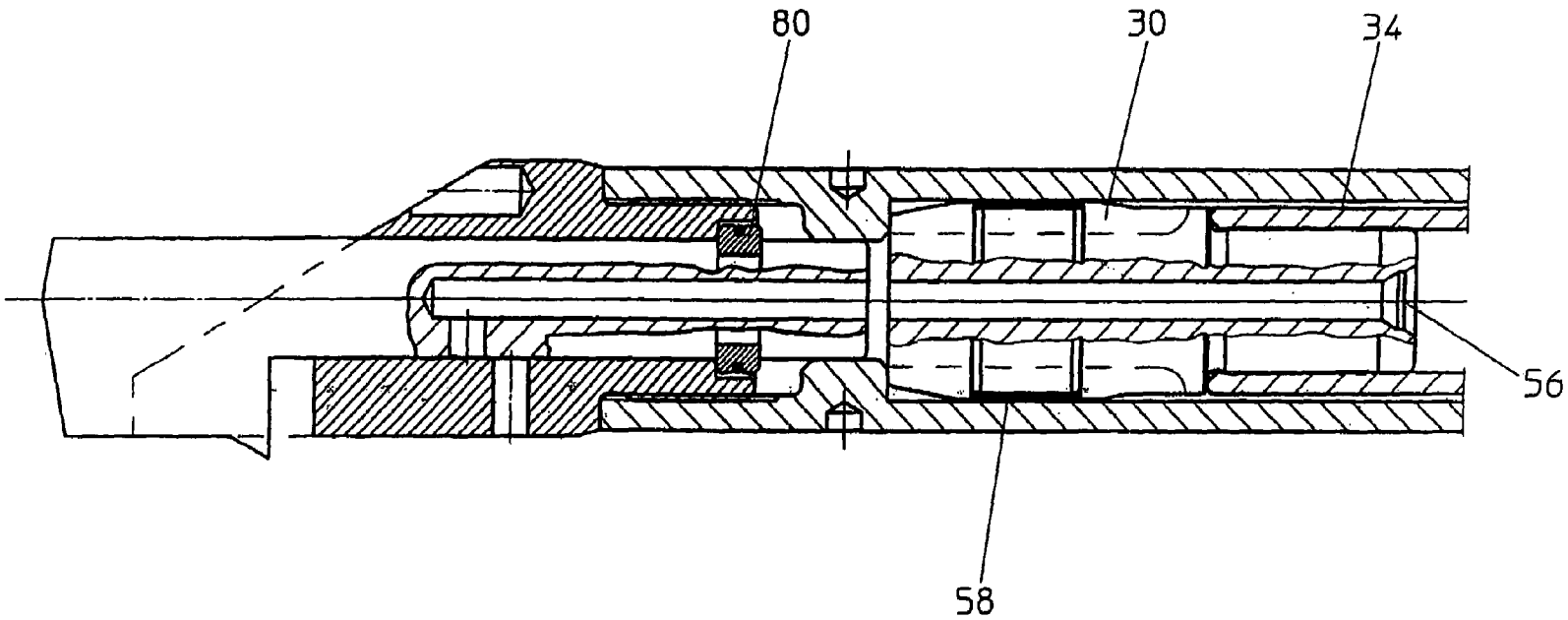
FIG. 5 shows the drilling head of FIG. 4 in closed nozzle position.

However, the drilling apparatus 1 according to the invention can also have a separator 74, which permits water and air to be separated in the drilling apparatus and, given an appropriate arrangement, ensures that the impact piston is supplied substantially with air and the outlet nozzle substantially with water. Such an embodiment is illustrated in FIGS. 2 and 3.

Film-forming additives can be admixed to the drilling liquid, so that the drilling liquid simultaneously leads to a reduction in the friction between the impact piston and liner of the impact piston. The impact piston can also have slip bands 58, for example of PTFE, these preferably being operated with a drilling apparatus with separator 74.

Figure 6:
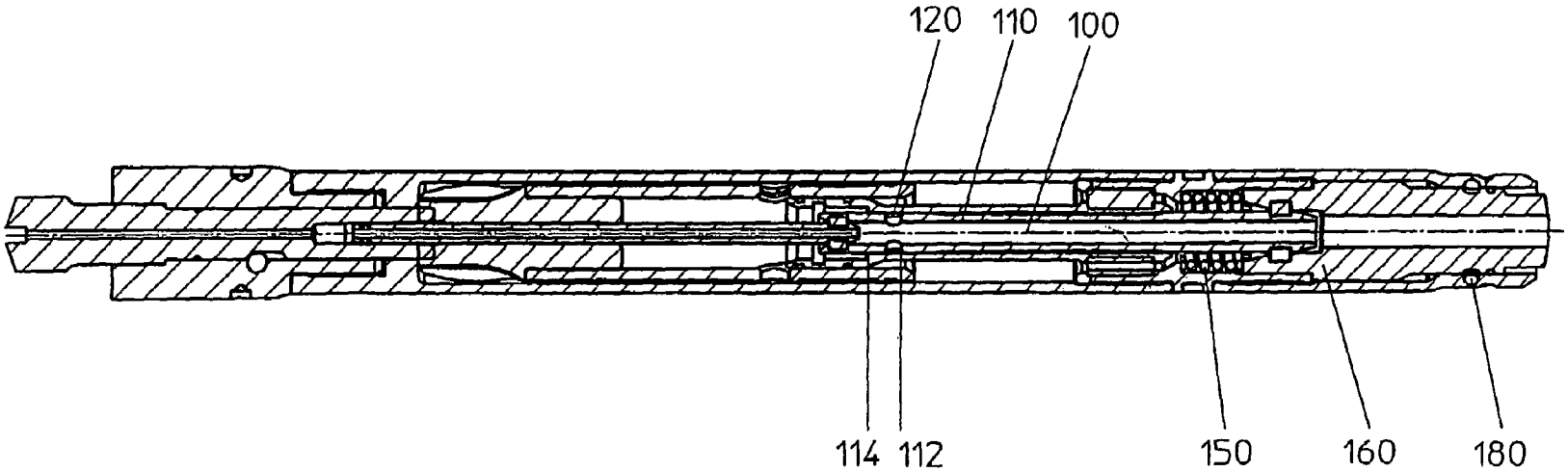
FIG. 6 shows an embodiment of the drilling apparatus according to the invention with a device for connecting and disconnecting the compressed air supply to the impact piston.

In the exemplary embodiment illustrated in FIG. 6, the channel has a device for connecting and disconnecting the feed line of the compressed air and of the drilling medium, in the form of a pressure tube 110 which is mounted such that it can be displaced and has a pressure chamber 100 and a hole 120. The pressure tube 110 can be displaced between two positions 112 and 114 and, in position 112, closes the connection to the pressure chamber of the impact piston, so that the piston comes to a standstill. By means of a spring 150, the pressure tube 110 is held in the basic state in the position 112, so that the impact drive is connected when the force of the spring 150 is overcome by external pressure, for example via the thrust string because of a specific resistance in the working face.

In the basic position, at the same time the waste-air channels 180 are closed by a slide 160, the connection between the channel and the drilling or impact tool remaining open.

The invention claimed is:

1. A method for operating a ground drilling apparatus, whereas said drilling apparatus is driven forward alternately either in rotation, percussively, or combined in rotation and percussively, characterized in that compressed air is fed to said drilling apparatus during the percussive drilling and a drilling medium is fed to said drilling apparatus during the rotational drilling, whereas the compressed air and the drilling medium is supplied via the same channel, and further characterized in that film-forming additives are admixed to the drilling medium.

2. An apparatus for horizontal ground drilling, that can be operated percussively and in rotation, having a drilling and impact tool, an impact piston and a media feed line, characterized in that the media feed line has a channel which is constructed in such a way that said channel can alternately supply compressed air to the impact piston and a drilling medium to the drilling head and that the channel has a device for connecting and disconnecting the feed line of the compressed air and/or the drilling medium to the impact piston drilling head.

3. The apparatus as claimed in claim 2, characterized in that the feed line is led through the impact piston.

4. The apparatus as claimed in claim 2, characterized in that the feed line is led past the piston.

5. The apparatus as claimed in claim 2, characterized by a drilling string which has only one channel for the feed line for compressed air and drilling medium.

6. The apparatus as claimed in claim 2, characterized by a chisel head which can be moved axially and is arranged on the head of the drilling apparatus in such a way that the impact piston can transmit the entire impact impulse to the hammer point.

7. The apparatus as claimed in claim 6, characterized in that the hammer point has an oversize.

8. The apparatus as claimed in claim 2, characterized by a separator.

9. The apparatus as claimed in claim 2, characterized by a lateral channel guide for a drilling liquid channel.

10. The apparatus as claimed in claim 2, characterized in that the device for connecting and disconnecting the feed line of the compressed air and/or of the drilling medium is provided as a pressure chamber within the housing, the pressure chamber having a valve or a through-hole as a connection from the pressure medium source to the impact piston, which valve or through-hole can be actuated via the pulling or thrusting means.

11. The apparatus as claimed in claim 10, characterized in that the pressure chamber is constructed as a pressure tube mounted within the housing such that said pressure tube can be displaced axially between two positions via the pulling or thrusting means, the valve or the through-hole being open in one position and closed in a second position.

12. The apparatus as claimed in claim 11, having a control tube, characterized in that the pressure tube is arranged within the control tube, and the control tube opens the through-hole in one position and closes said through hole in a second position.

13. The apparatus as claimed in claim 11, characterized in that the pressure tube is held by a spring element in a basic position with the valve closed or the through-hole closed.

14. The apparatus as claimed in claim 13, characterized in that, in the closed position, the pressure chamber simultaneously effects closure of waste-air channels of the impact piston.

15. The apparatus as claimed in claim 14, characterized by a slide for closing the waste-air channels.

* * * * *